US007014713B2

(12) United States Patent
Nakane

(10) Patent No.: US 7,014,713 B2
(45) Date of Patent: Mar. 21, 2006

(54) COATING MACHINE

(75) Inventor: Shinichi Nakane, Aichi (JP)

(73) Assignee: Trinity Industrial Corporation, Aichi (JP)

( * ) Notice: Subject to any disclaimer, the term of this patent is extended or adjusted under 35 U.S.C. 154(b) by 0 days.

(21) Appl. No.: 10/938,507

(22) Filed: Sep. 13, 2004

(65) Prior Publication Data

US 2005/0076832 A1 Apr. 14, 2005

(30) Foreign Application Priority Data

Sep. 12, 2003 (JP) ..... 2003-322147

(51) Int. Cl.
*B05B 3/00* (2006.01)
*B05B 7/00* (2006.01)
*B05C 5/00* (2006.01)

(52) U.S. Cl. ..... 118/300; 118/323; 239/305; 222/325

(58) Field of Classification Search ..... 118/300, 118/323; 239/302, 303, 304, 305; 901/43; 222/325

See application file for complete search history.

(56) References Cited

U.S. PATENT DOCUMENTS

| | | | | |
|---|---|---|---|---|
| 4,323,097 | A * | 4/1982 | Achen | 141/168 |
| 6,071,346 | A * | 6/2000 | Yamauchi et al. | 118/668 |
| 6,666,164 | B1 * | 12/2003 | Yoshida et al. | 118/323 |
| 6,712,285 | B1 * | 3/2004 | Provenaz et al. | 239/1 |
| 6,742,722 | B1 * | 6/2004 | Hosoda et al. | 239/305 |

FOREIGN PATENT DOCUMENTS

JP 2000-317354 11/2000

OTHER PUBLICATIONS

English language Abstract of JP 2000-317354.

* cited by examiner

*Primary Examiner*—Chris Fiorilla
*Assistant Examiner*—Yewebdar Tadesse
(74) *Attorney, Agent, or Firm*—Greenblum & Bernstein, P.L.C.

(57) ABSTRACT

A coating machine in which a machine body formed with a coating material atomizing mechanism is detachably provided with a cartridge for filling a coating material wherein a cartridge attaching portion formed to the machine body is provided with a guide that slidably guides a new cartridge driven in from one end into a coupling position and drives a used cartridge pushed by the new cartridge from the coupling position to the other end.

6 Claims, 6 Drawing Sheets

COATING MACHINE

BACKGROUND OF THE INVENTION

1. Field of the Invention

The present invention concerns a coating machine in which a cartridge for filling a coating material is mounted detachably to a machine body provided with a coating martial atomizing mechanism.

2. Statement of Related Art

In coating of car bodies, coating materials using organic solvents are predominant, but it has been demanded to decrease volatile organic solvents that evolve in a great amount in the coating process with a view point of environment preservation and prevention of public pollution and, as a countermeasure, coating with aqueous coating materials has attracted attention.

For using an aqueous coating with no loss, it is preferred to apply coating by an electrostatic coating apparatus of high coating efficiency. However, since the aqueous coating material has low electric resistance tending to electrically conduct the rotary atomizing head and the ground of the electrostatic coating machine by way of a coating material flowing through a coating material supply system, insulation has to be applied over the entire coating material supply system to prevent leakage of high voltage of −60 to 90 kV applied to the rotary atomizing head.

Accordingly, a coating material is filled in a coating material tank formed in a coating machine or a coating material is filled in a cartridge mounted detachably to a coating machine and a coating martial is discharged under pressure from the coating material tank or the cartridge for coating thereby electrically shielding the coating material supply system in order not to leak a high voltage even when it is applied to the coating machine (refer to Japanese Unexamined Patent Publication No. 2000-317354)

By the way, since the cartridge is filled with a coating material usually by an amount necessary to coat one car body, cartridges have to be exchanged within a short period time from the completion of coating for a preceding car body being conveyed on a coating line till reaching of a succeeding car body and, accordingly, exchange for cartridges is automated.

In a case of exchanging cartridges for a coating machine provided with a coating material atomizing head at the front and provided with a cartridge mounting portion at the back of a machine body, an arm of a cartridge exchange robot is advanced just above a coating machine positioned to a cartridge exchange position with the mounting portion being upwarded to catch a used cartridge, which is extracted upwardly, retracted to a predetermined position and stored therein. Then a new cartridge is held to advance just above the coating machine and then displaced downwardly and enforced in the coating machine for loading.

That is, since the arm of the exchange robot has to move in different directions at least between a case of extracting a cartridge loaded on the coating machine or enforcing a new cartridge to conduct loading and unloading and a case of retracting the cartridge extracted from the coating machine or advancing a new cartridge just above the coating machine, the size of the exchange robot is enlarged to result in a problem of requiring a large exchange space along the coating line.

Further, since car bodies of different coating colors are conveyed together to a coating line, the coating machine has to be cleaned for color change on every exchange of cartridges and, accordingly, it is desired to further shorten the exchange time.

However, since the new cartridge can not be loaded unless the extracted used cartridge is stored, it takes a long time for exchange. When exchange is intended to conduct in a short period of time, it leads to a problem of requiring an exchange robot having an extracting robot arm and a loading robot arm separately, which enlarges the size of the robot per se and increases the cost.

SUMMARY OF THE INVENTION

In view of the above, the present invention intends to solve a technical subject for enabling cartridges to be exchanged extremely simply and rapidly even in a narrow space.

The foregoing subject has been solved according to the present invention in a coating machine in which a cartridge for filling a coating material is mounted detachably to a machine body provided with a coating material atomizing mechanism, wherein a cartridge attaching portion formed to the machine body is provided with a guide for slidably guiding a new cartridge driven-in from one end thereof to a coupling position and driving-out a used cartridge pushed by the new cartridge from the coupling position to the other end.

Further, the cartridge exchange apparatus according to the invention comprises a push-in guide for guiding a new cartridge to be exchanged to an exchange position where a coating machine is positioned upon exchange of cartridges and a retraction guide for retracting a cartridge detached from a coating machine formed on both sides of a guide formed to a attaching portion of the coating machine, and a handling unit for driving-in and attaching the cartridge to the coating machine positioned at the exchange position and recovering the cartridge driven-out to the retraction guide.

According to the coating machine of the invention, when the new cartridge is driven-in along the guide formed to the attaching portion from one end to the coupling position, the used cartridge attached so far to the coating machine is pushed and guided slidably from the coupling position to the other end being, so that detachment of the used cartridge and attachment of the new cartridge can be conducted by one operation simultaneously.

Further, according to the cartridge exchange apparatus of the invention, when a new cartridge taken out, for example, from a stocker is driven-in along the push-in guide by the handling unit, since the push-in guide is formed continuously on one end of the guide of the coating machine, a new cartridge is transferred to the guide of the coating machine and attached as it is to the coating machine.

In this case, since the retraction guide for retracting the cartridge detached from the coating machine is formed continuously on the other end of the guide of the coating machine, the cartridge attached so far to the coating machine is driven-out to the retraction guide by the new cartridge driven-in from the push-in guide.

That is, since the used cartridge is detached by merely attaching the new cartridge, the new cartridge can be attached without operation of detaching the used cartridge.

DESCRIPTION OF THE ACCOMPANYING DRAWINGS

Preferred embodiments of the present invention will be described in details based on the drawings, wherein FIG. 1 is an explanatory view showing an embodiment of applying a coating machine according to the present invention to an electrostatic coating machine;

FIGS. 4(*a*)–4(*d*) are explanatory views showing cartridge exchanging operation;

FIGS. 5(*a*)–5(*d*)are explanatory views showing cartridge exchanging operation; and FIGS. 6(*a*)–6(*e*)are explanatory views showing cartridge exchanging operation.

DESCRIPTION OF PREFERRED EMBODIMENTS OF THE INVENTION

In the present invention, the subject of exchanging cartridges simply and rapidly is attained by an inventive concept for attaching and detaching directions of cartridges thereby enabling to attache or detach them in one operation.

Figure 1:
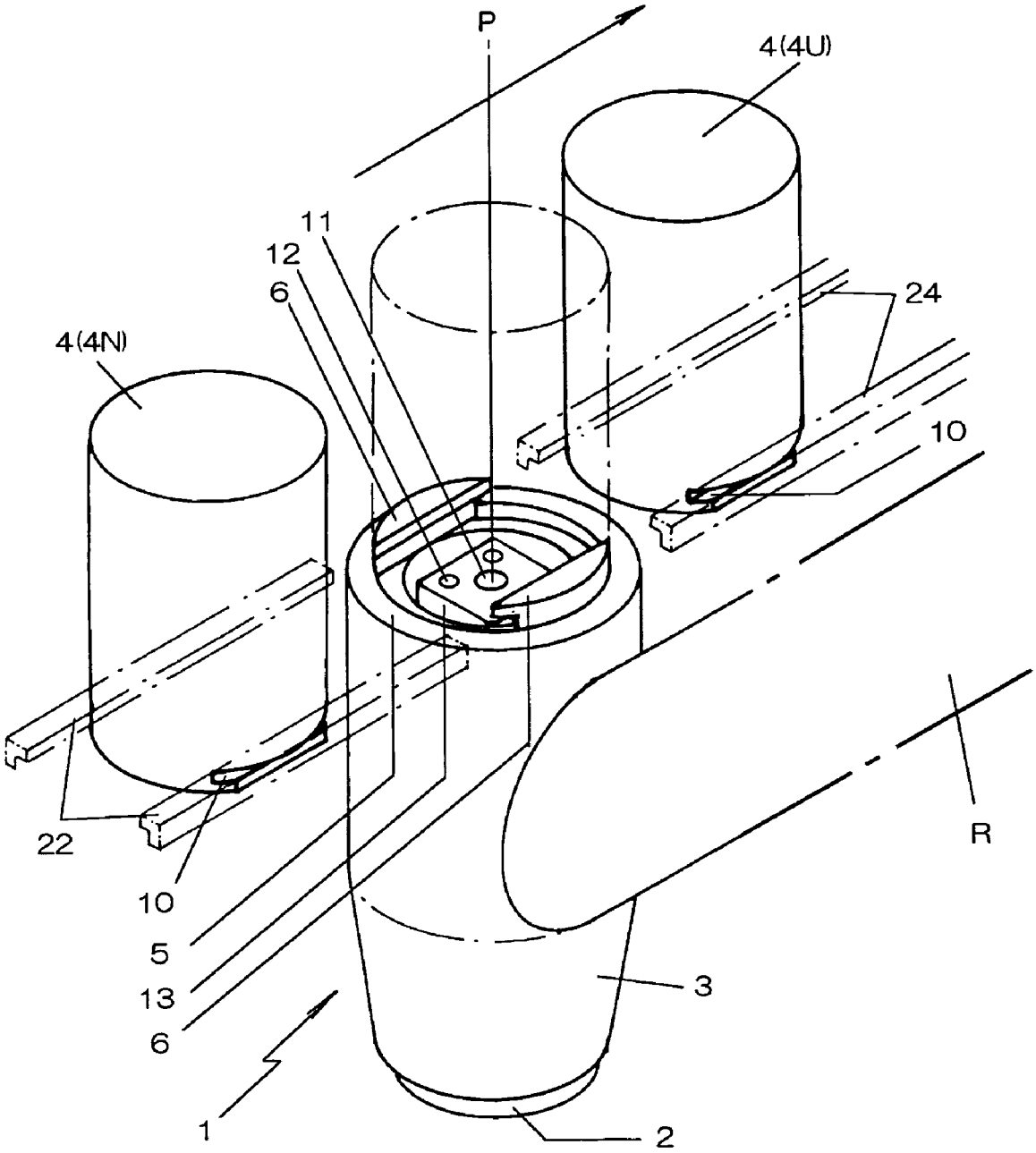
Figure 2:
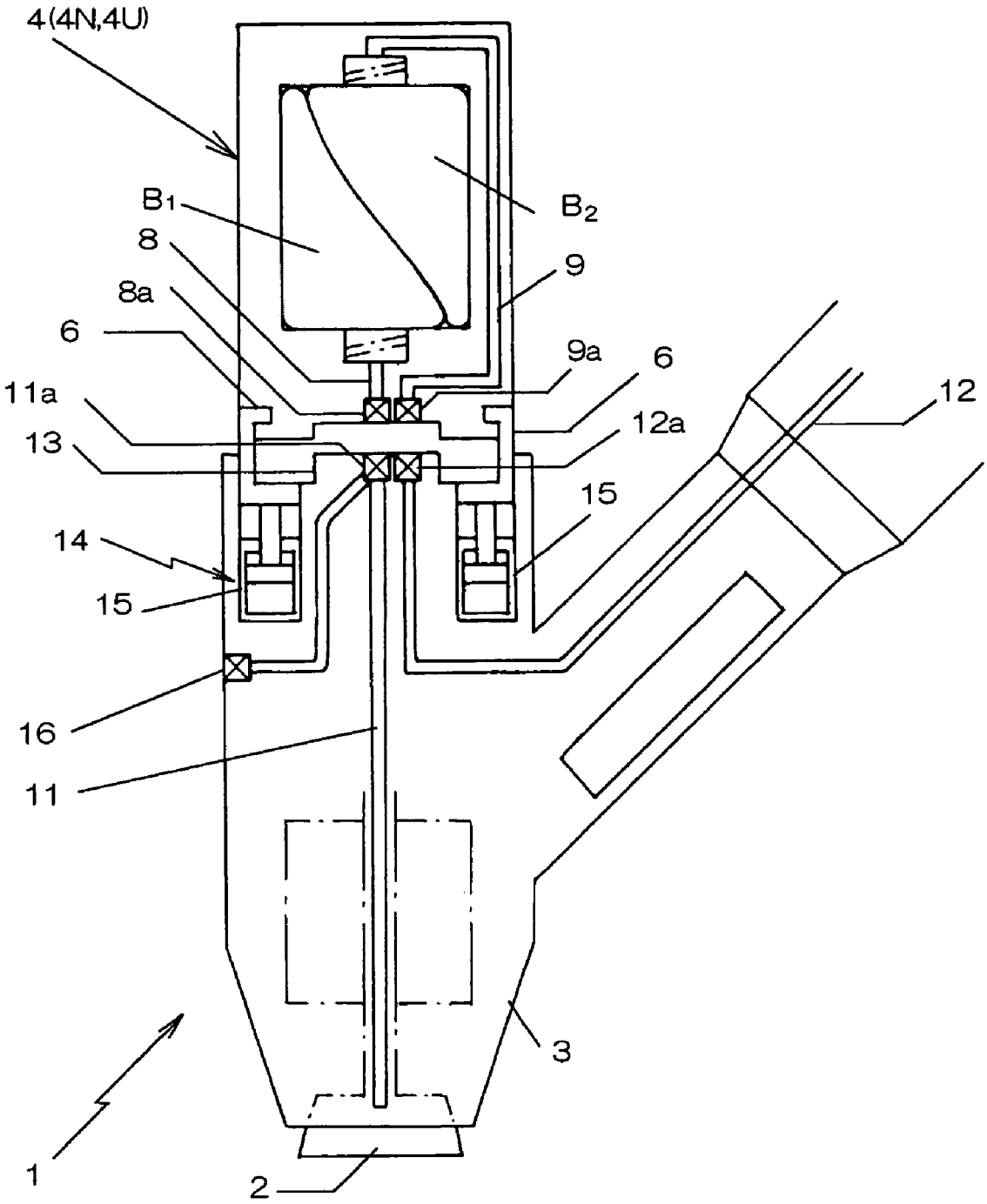
FIG. 2 is a cross sectional view of the embodiment.
Figure 3:
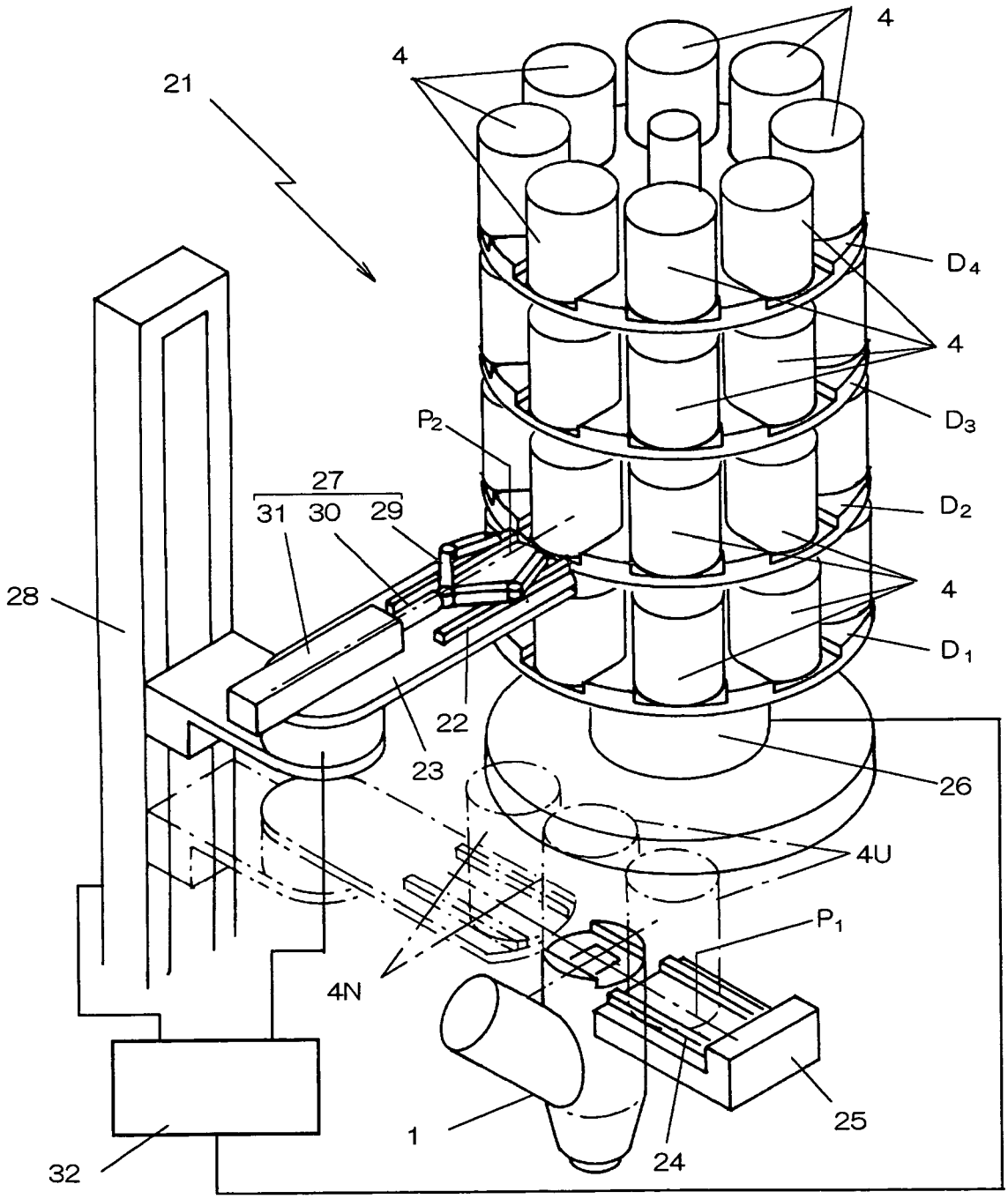
FIG. 3 is an explanatory view showing an embodiment of a cartridge exchange apparatus according to the invention.
Figure 4A:
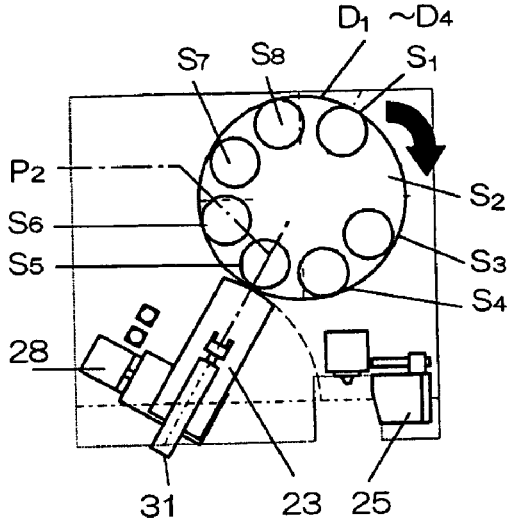
Figure 4B:
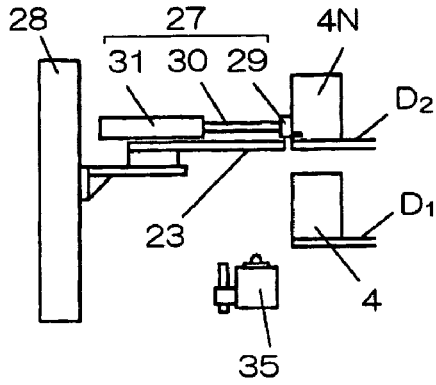
Figure 4C:
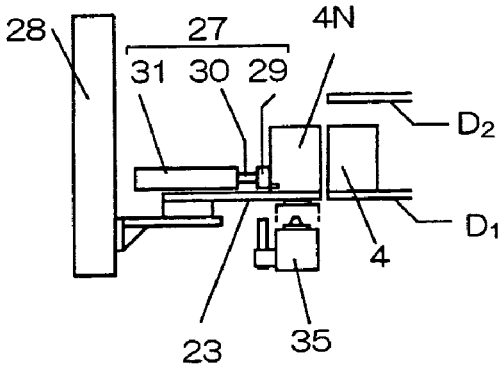
Figure 4D:
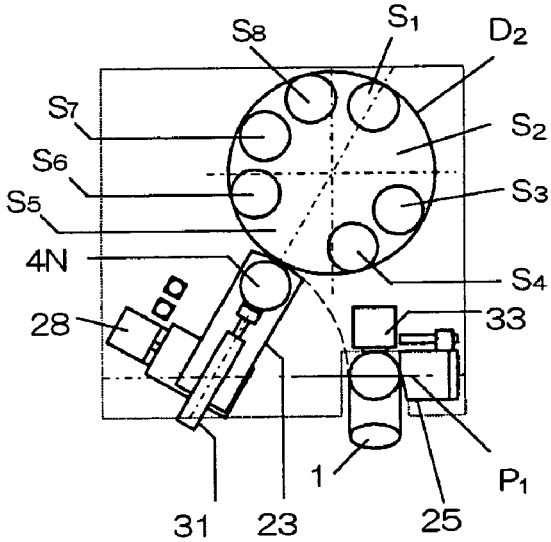
Figure 5A:
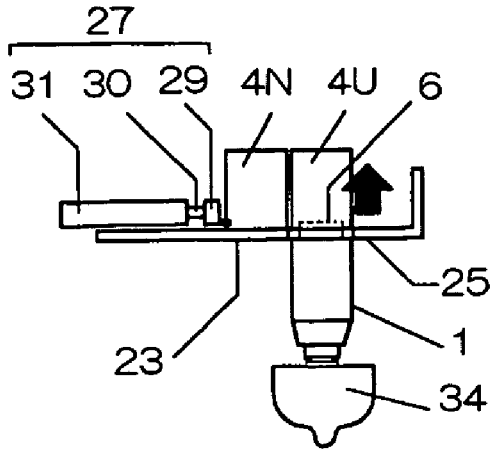
Figure 5B:
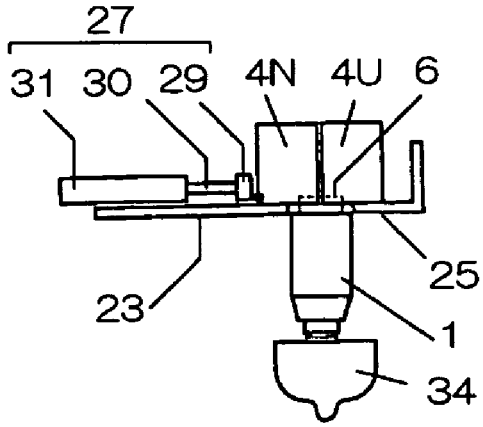
Figure 5C:
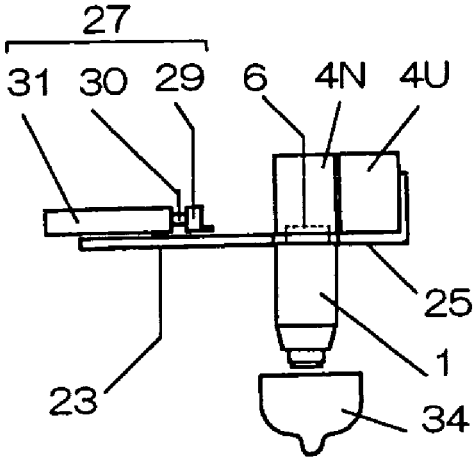
Figure 5D:
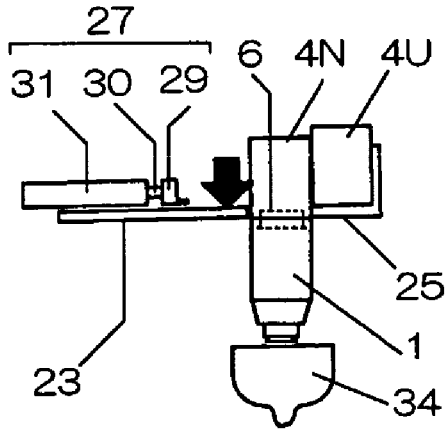
Figure 6A:
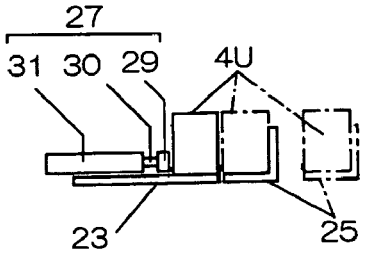
Figure 6B:
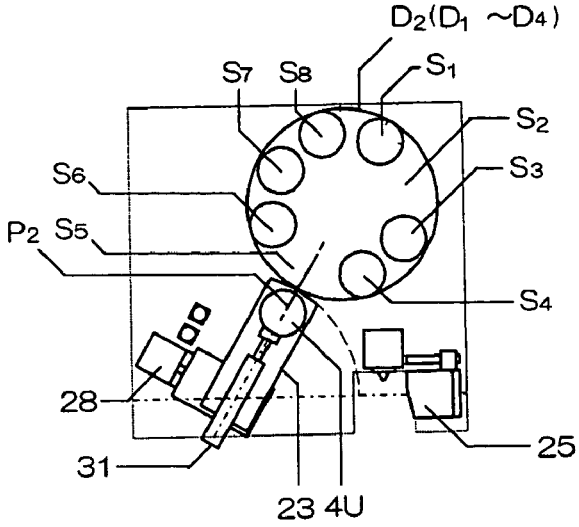
Figure 6C:
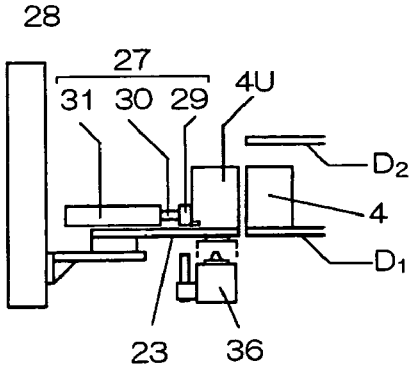
Figure 6D:
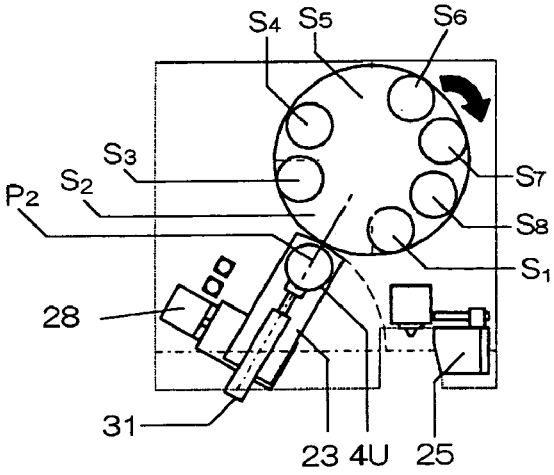
Figure 6E:
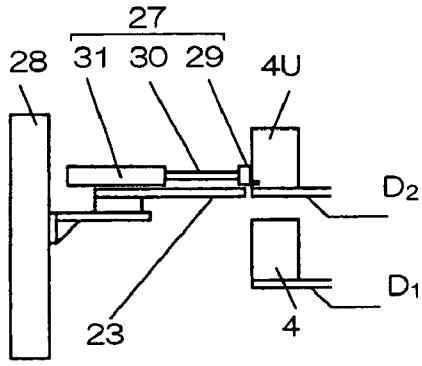

FIG. 1 is an explanatory view showing an embodiment of applying a coating machine according to the invention to an electrostatic coating machine, FIG. 2 is a cross sectional view of the embodiment, FIG. 3 is an explanatory view showing an embodiment of a cartridge exchange apparatus according to the invention and FIG. 4 to FIG. 6 are explanatory views showing the cartridge exchanging operation.

An electrostatic coating machine 1 shown in FIG. 1 is attached to the top end of a robot arm R. A rotary atomizing head (coating material atomizing mechanism) 2 is provided at the front of a machine body 3, and an attaching portion 5 for attaching a cartridge 4 for filling coating material is provided at the back of the machine body 3.

Then, a guide 6 is formed to the attaching portion 5 for slidably guiding a new cartridge 4 (4N) driven-in to the coupling position from one end thereof and slidably guiding the used cartridge 4 (4U) pushed by the new cartridge 4 (4N) so as to be driven-out from the coupling position P to the other end.

The cartridge 4 is in a substantially cylindrical outer shape, and has a coating material filling/discharging port 8, and an operation fluid entrance 9 for receiving the supply of a coating material discharging operation fluid from the coating machine 1 upon discharge of the coating material each formed to the attaching portion 7 of the cartridge 4 opposing to an attaching portion 5 of the coating machine 1, and guide grooves 10 for engagement with the guide 6 formed in parallel on both left and right sides.

A coating material bag $B_1$ in communication with the coating material filling/discharging port 8 and an operation fluid $B_2$ connected with the operation fluid inlet 9 are mounted inside of the cartridge 4 such that the coating material and the operation fluid are not mixed.

The attaching portion 5 is provided with a joint 13 having a coating material port 11 and an operation fluid port 12 that are engaged in an air tight manner to the coating material filling/discharging port 8 and the operation fluid inlet 9 of the cartridge 4 position at the coupling portion P while advancing to and retracting from them relatively.

In this embodiment, engagement/disengagement mechanism 14 is provided for engaging and disengaging the cartridge 4 to and from the joint 13 by the protrusion and retraction of the guide 6.

The joint engaging/disengaging mechanism 14 has an air cylinder 15 for advancing and retracting the guide 6 in the vertical direction (engaging and disengaging direction) with the rotary atomizing head 2 being faced downwardly and the air cylinder is driven by air supplied from the robot arm R.

The coating material filling/discharging port 8 and the operation fluid inlet 9 of the cartridge 4 and the coating material port 11 and the operation fluid port 12 of the joint 13 are provided with valve mechanisms 9*a*, 9*a*, 11*a* and 12*a* that are opened only upon engagement and closed upon disengagement.

Accordingly, as shown in FIG. 2, when the air cylinder 15 for the joint engaging/disengaging mechanism 14 is extended in a case where the coating machine 1 is positioned at the cartridge exchange position Pi, the guide 6 is raised upwardly to disengage the attached cartridge 4 and the joint 13.

In this state, when a new cartridge 4N to be exchanged is guided slidably along the guide 6 and driven-in from one end into the coupling position P, the used cartridge 4U is driven-out from the coupling position P to the other end being driven by the new cartridge 4N. Then, when the air cylinder 15 of the joint engaging/disengaging mechanism 14 contracts, the guide 6 is lowered to engage the new cartridge 4N with the joint 13 to render the coating machine 1 into a state capable of coating.

FIG. 3 shows an example of a cartridge exchange apparatus according to the invention.

The cartridge exchange apparatus 21 is adapted to conduct cartridge exchange relative to the coating machine 1 shown in FIG. 1 and it comprises a chucking table 23 provided with a push-in guide 22 for guiding a new cartridge 4N to be exchanged relative to the coating machine 1 positioned at the exchange position $P_1$ upon exchange of cartridges, a recovery table 25 provided with a retraction guide 24 for retracting a used cartridge 4U detached from the coating machine 1, and a handling unit 27 for taking out a new cartridge 4N from a stocker 26 and driving it along the push-in guide 22 and recovering the used cartridge 4U driven-out to the retraction guide 24.

The chucking table 23 is provided rotationally swingeably for the cartridge exchange position $P_1$ and the cartridge take-out position $P_2$ of the stocker 26 and is attached to a lift 28 moved vertically to an optional height.

Further, the recovery table 25 is located such that the push-out guide 24 is in continuous with the guide 6 of the coating machine 1 positioned at the cartridge exchange portion $P_1$.

Accordingly, in a state where the coating machine 1 is positioned at the cartridge exchange position $P_1$, the air cylinder 15 for the joint engaging/disengaging mechanism 14 is operated to engage and disengage the cartridge 4 and the joint 13.

The stocker 26 is formed in the shape of a tower in which disks $D_1$ to $D_4$ each having storage spaces $S_1$ to $S_8$ formed isogonally for housing plural cartridges 4, 4 - - - , by four stages and the disks $D_1$ to $D_4$ are rotated under control such that when a predetermined address is designated to each of the storage spaces $S_1$ to $S_8$, each of corresponding storage spaces $S_i$ to $S_8$ is positioned to the cartridge take-out position $P_2$.

The address is expressed, for example, by the combination of a disk number d (=1 to 4) and a space number s (=1 to 8) in which the height is determined by the disk number d and the rotational angle upon positioning the storage spaces $S_1$ to $S_8$ to the cartridge take out position $P_2$ is determined by the space number s.

The handling unit 27 is provided with a piston 31 mounted on the chucking table 23 for advancing and retracting a piston rod 30 having a cartridge clamper 29 at the top end along a push-in guide 22.

The chucking table 23, the recovery table 24, the stocker 26 and the handling unit 27 are driven under control by a control device 32, the disks $D_1$ to $D_4$ are rotated integrally such that the corresponding storage spaces $S_1$–$S_8$ is positioned at a cartridge take out position $P_2$ when the address (d, s) is determined, the chucking table 23 is elevated by the lift 28 to a height for the disks $D_1$ to $D_4$ corresponding to the address, and the piston 31 is operated such that the cartridge 4 (4N, 4U) is loaded and unloaded relative to the positioned storage space $S_1$ to $S_8$.

When a new cartridge 4N is extracted onto the chucking table 23, engaged with the push-in guide 22, and the coating machine 1 is positioned to the cartridge exchange position $P_1$, the chucking table 23 turns direction to the cartridge exchange position $P_1$.

In this case, since the piston 31 of the handling unit 27 is operated so as to push-in the cartridge 4N along the push-in guide 22 to the positioned coating machine 1, the used cartridge 4U attached so far to the coating machine 1 is driven-out to the retraction guide 24 of the recovery table 25.

Then, when the coating machine 1 recedes from the cartridge exchange portion Pi, the used cartridge 4U driven-out to the retraction guide 24 is caught by the clamper 27 and transferred on the push-in guide 22 in place of the new cartridge and returned to the stocker 26 by the operation opposite to that in the attaching operation.

At the cartridge exchange position $P_1$ are provided a cleaning connector 33 for cleaning the inside of the coating machine 1 by supplying cleaning liquid and air being connected with a cleaning port 16 formed to the peripheral surface of the coating machine 1 and a cleaning cover 34 for the recovery of the cleaning liquid.

Further, at the cartridge take out position $P_2$, are provided a coating material filling connector 35 and a cartridge cleaning connector 36 for filling a coating material to the new cartridge 4N loaded from the stocker 26 on the push-guide 22, and a cartridge cleaning connector 36.

The operation of one embodiment of the electrostatic coating machine and the cartridge exchange apparatus applied with the present invention is to be described in conjunction with FIG. 4 to FIG. 6.

For example, description is to be made to a case where coating has been conducted by attaching a cartridge 4 for filling a red coating material stored in the storage space $S_2$ of a disk $D_2$ at the second stage from the bottom and, after the completion of the coating, coating is applied by exchanging the cartridge with a cartridge for filling a white coating material stored in the storage space $S_5$ in the third disk $D_2$ from the bottom.

At first, when the address (d, s)=(2, 5) for the storage space $S_5$ for the cartridge 4 for filling the white coating material is designated during coating of the red coating material by the electrostatic coating machine, the disks $D_1$ to $D_4$ are rotated together by the control device 30 and the storage space $S_5$ is positioned at the cartridge take-out position $P_2$ (FIG. 4(*a*)).

Then, the chucking table 23 is raised to a height for the disk $D_2$ by the lift 28 by the operation of the handling unit 27, the piston rod 30 is extended and the clamper 27 catches the cartridge 4N in the storage space $S_5$ and extracts the cartridge 4N onto the chucking table 23 and engages cartridge with the push-in guide 22 (FIG. 4(*b*)).

Then, when the chucking table 23 is lowered to a height for the cartridge exchange position $P_1$ by the lift 28, the coating material filling connector 35 is elevated and engaged to the coating material filling/discharging port 8 of the cartridge 4N and filled with the white coating material. After completing the filling of the coating material, it stands by in a state where the coating material filling connector 35 is lowered. (FIG. 4(*c*)).

On the other hand, when the electrostatic coating material 1 after completing the coating is positioned at the cartridge exchange position $P_1$, the coating machine cleaning connector 33 is combined with the cleaning port 16 formed to the peripheral surface of the coating machine 1, and the cleaning cover 34 is elevated to cover the rotary atomizing head 2, and the inside of the coating machine 1 and the rotary atomizing head 2 are cleaned. (FIG. 4(*d*)).

In this state, when the air cylinder 15 of the joint engaging/disengaging mechanism 14 is extended by driving air supplied by way of the robot arm R, since the guide 6 holding the cartridge 4U is elevated, engagement between the cartridge 4U and the joint 13 is released (FIG. 5(*a*)).

Then, when the chucking table 23 is directed to the cartridge exchange position $P_1$ and a new cartridge 4N is driven-in by the piston 31, the cartridge 4N transfers from the push-in guide 22 to the guide 6 for the coating machine 1 and guided slidably as far as the coupling position P while driving out the used cartridge 4U to the retraction guide 24 of the recovery table 25 (FIG. 5(*b*)).

When the piston 31 is retracted upon positioning of the new cartridge 4N at the coupling position P (FIG. 5(*c*)), and the air cylinder 15 of the joint engaging/disengaging mechanism 14 is contracted by the driving air supplied by way of the robot arm R, since the cartridge 4N is lowered into the machine body 3 by the joint engaging/disengaging mechanism 14 and connected with the joint 13, the coating machine is put in a state capable of coating (FIG. 5(*d*)).

Then, when the coating machine 1 is away from the cartridge exchange position $P_1$, the recovery table 25 advances as far as the chucking table 23 and, at the same time, the piston 31 extends as far as the recovery table 25 and the clamper 29 at the top end of the piston rod 30 catches the used cartridge 4U driven-out to the retraction guide 24 and pulls it back onto the chucking table 23 (FIG. 6(*a*)).

Then, the chucking table 23 is directed to the cartridge take-out position $P_2$ (FIG. 6(*b*)). In a case where it is necessary for cleaning the inside of the used cartridge 4U, the cartridge cleaning connector 36 is elevated and engaged with the cartridge 4U to clean the inside of the cartridge 4 (FIG. 6(*c*)).

Meanwhile, the stocker 26 is rotated and the storage space $S_2$ corresponding to the designated address (d, s)=(2, 2) is positioned at the cartridge take-out position $P_2$ (FIG. 6(*d*)).

Then, the chucking table 23 is elevated to the height for the disk $D_2$ by the lift 28 after cleaning in a case of cleaning the inside of the used cartridge 4U or directly in a case of not cleaning the inside, and the piston rod 30 is extended to return the cartridge 4U to the storage space $S_2$ (FIG. 6(*e*)).

As described above according to this embodiment, when the new cartridge 4N is driven-in along the guide 6 formed to the attaching portion 5 from one end thereof to the coupling position, the used cartridge 4U attached so far to the coating machine 1 is slidably guided and driven-out from the coupling position to the other end, so that the cartridges can be exchanged extremely simply and rapidly by conducting attachment and detachment of the cartridges in one operation.

Further, when a stocker 26 in the form of a tower that houses multi-stages of disks $D_1$ to $D_4$ in which plural storage spaces $S_1$ to $S_8$ are isogonally formed is used, a number of cartridges 4 can be housed in a narrow installation space.

The operation fluid bag may not necessary be located in the cartridge 4 but the operation fluid may be supplied to the outside of the coating material bag $B_1$ while locating only the coating material bag $B_1$ in the cartridge.

Since cartridges capable of filling coating materials of optional colors can be exchanged rapidly, the invention is suitable for use in coating lines of conductive paints for automobile bodies in which works of different coating colors are conveyed successively on a conveyor at random and, further, this is applicable also to coating machines using non-conductive coating materials (solvent type paints) or coating machines for other coating oils or adhesives.

The present disclosure relates to subject matter contained in priority Japanese Patent Application No. 2003-322,147 filed on Sep. 12, 2003, the contents of which is herein expressly incorporated by reference in its entirety.

What is claimed is:

1. A coating machine in which a cartridge for filling a coating material is mounted detachably to a machine body provided with a coating material atomizing mechanism, wherein a cartridge attaching portion formed to the machine body is provided with a guide for slidably guiding a new cartridge driven-in from one end thereof to a coupling position and driving-out a used cartridge pushed by the new cartridge from the coupling position to the other end thereof.

2. A coating machine according to claim 1, wherein the attaching portion is provided with a joint which relatively advances or retracts to and from the filling/discharging port formed at the top end of the cartridge and is joined therewith in an air tight manner.

3. A coating machine according to claim 2, wherein the machine body comprises a joint engaging/disengaging mechanism for relatively advancing and retracting the joint by the external operation in a state of attaching the cartridge thereby engaging and disengaging the joint to and from filling/discharging port of the cartridge.

4. A cartridge exchange apparatus used for exchanging cartridges to a coating machine in which a cartridge for filling a coating material is mounted detachably to a machine body provided with a coating material atomizing mechanism, and a cartridge attaching portion formed to the machine body is provided with a guide for slidably guiding a new cartridge driven-in from one end thereof to a coupling position and driving-out a used cartridge pushed by the new cartridge from the coupling position to the other end thereof, wherein the apparatus comprises a push-in guide for guiding a new cartridge to be exchanged to an exchange position where a coating machine is positioned upon exchange of cartridges and a retraction guide for retracting a cartridge detached from a coating machine, formed on both sides of a guide formed to the attaching portion of the coating machine, and a handling unit for driving-in and attaching the cartridge to the coating machine positioned at the exchange position and recovering the cartridge driven-out to the retraction guide.

5. A cartridge exchange apparatus according to claim 4, comprising a stocker in which an address is set to each of storage spaces for storing plural cartridges one by one and comprising a control device for loading and unloading a cartridge by the handling unit to the storing space corresponding to an address when the address is designated.

6. A cartridge exchange apparatus according to claim 5, wherein the stocker is in the form of a tower housing plural stages of disks each formed with an isogonally divided storing space and a control device is provided for controlling the rotating of a disk such that a corresponding storage space is positioned to a cartridge take-put position when an address is designated and controlling to drive the handling unit so as to load and unload the cartridge relative to the positioned storage space.

* * * * *